US009193181B2

(12) United States Patent
Irie

(10) Patent No.: US 9,193,181 B2
(45) Date of Patent: Nov. 24, 2015

(54) RECORDING APPARATUS

(71) Applicant: SEIKO EPSON CORPORATION, Tokyo (JP)

(72) Inventor: Yoichiro Irie, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/547,787

(22) Filed: Nov. 19, 2014

(65) Prior Publication Data

US 2015/0158313 A1 Jun. 11, 2015

(30) Foreign Application Priority Data

Dec. 10, 2013 (JP) ..... 2013-254766

(51) Int. Cl.
*B41J 11/00* (2006.01)

(52) U.S. Cl.
CPC ..... *B41J 11/0015* (2013.01)

(58) Field of Classification Search
CPC ..... B41J 2/01; B41J 2/2114; B41J 11/0015; B41J 11/0065; B41J 11/007; B41J 11/0085; B41J 11/06; B41J 13/103; B41M 5/0017; B41M 5/52; B41M 7/00; C09D 11/30; C09D 11/40; C09D 11/54
USPC ..... 347/96, 101, 104
See application file for complete search history.

(56) References Cited

U.S. PATENT DOCUMENTS

| | | | | |
|---|---|---|---|---|
| 6,528,129 | B1 * | 3/2003 | Kondo | 427/536 |
| 2006/0056899 | A1 * | 3/2006 | Hayakawa | 400/605 |
| 2010/0171784 | A1 * | 7/2010 | Kitawaki et al. | 347/16 |
| 2011/0316909 | A1 * | 12/2011 | Yamanobe | 347/8 |
| 2012/0069117 | A1 * | 3/2012 | Sakurai et al. | 347/104 |

FOREIGN PATENT DOCUMENTS

| | | |
|---|---|---|
| JP | 2004-082531 A | 3/2004 |
| JP | 2008-207528 A | 9/2008 |

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

A recording apparatus includes a recording section configured and arranged to apply a liquid (UV ink) onto a recording medium (roll of paper) and record an image, a pre-treatment section (corona treatment section) configured and arranged to perform a pre-treatment on the roll of paper prior to when the UV ink is applied, and a first conveyance route along which the roll of paper is conveyed from the corona treatment section to the recording section. The first conveyance route has a first bend section configured and arranged to change the direction in which the roll of paper is conveyed.

10 Claims, 6 Drawing Sheets

RECORDING APPARATUS

CROSS-REFERENCE TO RELATED APPLICATIONS

This application claims priority to Japanese Patent Application No. 2013-254766 filed on Dec. 10, 2013. The entire disclosure of Japanese Patent Application No. 2013-254766 is hereby incorporated herein by reference.

BACKGROUND

1. Technical Field

The present invention relates to a recording apparatus.

2. Related Art

One conventionally known form of a recording apparatus is an inkjet-type printer provided with: a recording head for discharging ink onto an ink application surface of a recording medium; and a wettability improvement treatment apparatus for carrying out a wettability improvement treatment, such as a corona treatment, for improving the wettability to ink on the ink application surface of the recording medium, in advance of the application of the ink by the recording head (for example, see Japanese laid-open patent publication No. 2008-207528).

Also known is an inkjet-type printer which uses an ink containing an active energy ray-curing compound that can be cured by being irradiated with active energy rays, and which is provided with an active energy ray irradiating means for curing the applied ink after the ink has been applied to the ink application surface, a mechanism for adjusting the humidity of a region irradiated with the active energy rays, and the like (for example, see Japanese laid-open patent publication No. 2004-82531).

In the inkjet-type printers disclosed in Japanese laid-open patent publication No. 2008-207528 and Japanese laid-open patent publication No. 2004-82531, however, there has been a problem in that the inkjet-type printers end up becoming very long, because of the need to arrange the wettability improvement treatment apparatus before a recording section provided with the recording head for discharging the ink, i.e., on the upstream side of a path along which the recording medium is supplied, and to arrange the active energy ray irradiating means, humidity regulation mechanism, and the like after the recording section, i.e., on the downstream side of a path along which the recording medium is discharged (see, for example, Japanese laid-open patent publication No. 2004-82531 (FIG. 1)). As a result, there has been a problem in that locations for installing the inkjet-type printers end up being limited.

SUMMARY

Having been created in order to resolve the above-mentioned problems at least in part, the present invention can be implemented in the form of the application examples or aspects below.

A recording apparatus as in the present application example is characterized by comprising a recording section configured and arranged to apply a liquid onto a recording medium and record an image, a pre-treatment section configured and arranged to perform a pre-treatment on the recording medium prior to when the liquid is applied, and a first conveyance route along which the recording medium is conveyed from the pre-treatment section to the recording section, the first conveyance route including a first bend section configured and arranged to change a direction in which the recording medium is conveyed.

According to the present application example, the recording apparatus is provided with a recording section for applying a liquid onto a recording medium and recording an image, and a pre-treatment section for performing a pre-treatment on the recording medium prior to when the liquid is applied, and a first conveyance route along which the recording medium is conveyed from the pre-treatment section to the recording section is provided with a first bend section where the direction in which the recording medium is conveyed is changed. Therefore, in the configuration of the recording apparatus, it is possible to arrange in a direction with intersection between the direction in which the pre-treatment section extends and the direction in which the recording section extends. As a result, for example, when the recording apparatus is viewed as projected onto a floor where the recording apparatus is installed, then it becomes possible to arrange the pre-treatment section and the recording section so as to each have a region of overlap. Even in a case where the pre-treatment section and the recording section cannot be configured so as to overlap, then the pre-treatment section can still be installed, for example, in such a direction as where the projection area of the pre-treatment section becomes even smaller. In other words, the area occupied by the installation of the recording apparatus can be made narrower, and even in a case where the pre-treatment section is provided, it is still possible to provide a more compact recording apparatus that does not require a wide installation space.

A recording apparatus as in an application example above is characterized by further comprising a recording medium supply section configured and arranged to store the recording medium having been wound into a roll prior to when the pre-treatment is performed, and a second conveyance route along which the recording medium is conveyed from the recording medium supply section to the pre-treatment section, the second conveyance route including a second bend section configured and arranged to change the direction in which the recording medium is conveyed.

According to the present application example, the recording apparatus is provided with a recording medium supply section for storing the recording medium having been wound into a roll prior to when the pre-treatment is performed, and a second conveyance route along which the recording medium is conveyed from the recording medium supply section to the pre-treatment section is provided with a second bend section where the direction in which the recording medium is conveyed is changed. Therefore, in the configuration of the recording apparatus, it is possible to arrange so that the direction in which the pre-treatment section extends and the direction in which the recording medium is conveyed from the recording medium supply section to the pre-treatment section intersect with one another. As a result, the height of the place where the recording apparatus is installed can be further lowered, and it is possible to provide a more compact recording apparatus that does not require a large space even in a case where the pre-treatment section is provided.

A recording apparatus as in an application example above is characterized by further comprising a recording medium supply section configured and arranged to store the recording medium having been wound into a roll prior to when the pre-treatment is performed, and a second conveyance route along which the recording medium is conveyed from the recording medium supply section to the pre-treatment section, a pre-treatment exit position for the pre-treatment section from which the recording medium is fed out being provided to a higher position than a pre-treatment entry position for the pre-treatment section at which the recording medium enters in, the first bend section being provided in the first conveyance route at a higher position than the pre-treatment exit position, and the pre-treatment entry position being provided in the second conveyance route at a higher position than a position for the recording medium supply section from which the recording medium is fed out.

According to the present application example, the pre-treatment exit position is provided to a higher position than the pre-treatment entry position; in the first conveyance route along which the recording medium is conveyed from the pre-treatment section to the recording section, the first bend section is provided to a higher position than the pre-treatment exit position; and in the second conveyance route along which the recording medium is conveyed from the recording medium supply section to the pre-treatment section, the pre-treatment entry position is provided to a higher position than the position for the recording medium supply section from which the recording medium is fed out. In other words, the conveyance route of the recording medium going from the exit of the recording medium supply section to the first bend section is provided in a direction that rises successively going toward the direction of conveyance. As a result, where the pre-treatment section is provided, the conveyance route can still be configured more simply even in a case where the first bend section has been provided so as not to require a wide installation space.

A recording apparatus as in an application example above is characterized in that the recording medium supply section is provided to a position where the recording medium supply section overlaps with at least one of the pre-treatment section, the first conveyance route, and the recording section when the recording apparatus is viewed as being projected onto a floor surface where the recording apparatus is installed.

According to the present application example, the recording medium supply section is provided to a position where the recording medium supply section overlaps with the pre-treatment section, the first conveyance route, and/or the recording section when the recording apparatus is viewed as being projected onto a floor surface where the recording apparatus is installed. In other words, the floor surface where the recording apparatus is installed may be a smaller area than in a case where the recording medium supply section, the pre-treatment section, the first conveyance route, and the recording section are each arranged in series. As such, according to the present application example, it is possible to provide a more compact recording apparatus that does not require a wide installation space.

A recording apparatus as in an application example above is characterized by further comprising a splicing table configured and arranged to splice the recording medium having been led out from the recording medium supply section, the splicing table being provided to a region between the recording medium supply section and the pre-treatment section.

According to the present application example, a splicing table for splicing the recording medium having been led out from the recording medium supply section is provided to a region between the recording medium supply section and the pre-treatment section. In other words, for example, the task of splicing a roll of paper or other recording medium can be easily performed on a roll of paper that is near at hand, having been drawn out from the recording medium supply section before being introduced into the pre-treatment section. As a result, splicing can be performed without having to wastefully pull out the recording medium to be joined newly in order to perform the task of splicing or having to pass the recording medium to be joined newly through the pre-treatment section every time the task of splicing is performed.

A recording apparatus as in an application example above is characterized in that the splicing table is provided so as to be movable.

According to the present application example, the splicing table is provided so as to be movable. The splicing table is arranged close to the recording medium supply section, as stated above, and so doing makes it possible to perform splicing without having to wastefully pull out the recording medium to be joined newly in order to perform the task of splicing or having to pass the recording medium to be joined newly through the pre-treatment section every time the task of splicing is performed. However, when the splicing table is arranged close to the recording medium supply section, this may in some instances hinder the task of storing the roll of recording medium in the recording medium supply section. When the splicing table is provided so as to be movable, as in the present application example, the splicing table can, for example, be arranged close to the recording medium supply section in a case where the splicing task is being performed and can be moved to a position away from the recording medium supply section in a case where the task of storing the recording medium in the recording medium supply section is being performed, and this makes it even easier to perform each of these tasks.

A recording apparatus as in an application example above is characterized in that the first bend section includes a tension sensor configured and arranged to detect a tension received by the recording medium in the first conveyance route.

According to the present application example, the first bend section is provided with a tension sensor for detecting a tension received by the recording medium in the first conveyance route. The tension received by the recording medium at the first conveyance route generates a stress on the first bend section where the direction of conveyance of the recording medium is changed on the first conveyance route. Detecting this stress in the first bend section makes it possible to detect the tension received by the recording medium. In other words, the first bend section can doubly bear a function as a tension sensor for detecting the tension received by the recording medium. As a result, a simpler configuration can be achieved because it is no longer necessary to provide the first bend section and the tension sensor separately in a recording apparatus where a tension sensor for detecting the tensions received by the recording medium is needed.

A recording apparatus as in an application example above is characterized in further comprising a recording medium end sensor configured and arranged to detect a position of an end of a width direction of the recording medium being conveyed in the first conveyance route, and a steering mechanism configured and arranged to carry out positional adjustments in the width direction for the recording medium being conveyed in the first conveyance route on the basis of positional information about the end detected by the recording medium end sensor, the recording medium end sensor being provided between the first bend section and the recording section in the first conveyance route.

According to the present application example, the recording apparatus is provided with a recording medium end sensor for detecting the position of an end of the width direction of the recording medium being conveyed in the first conveyance route, and a steering mechanism for carrying out positional adjustments in the width direction for the recording medium being conveyed in the first conveyance route on the basis of positional information about the end detected by the recording medium end sensor. This steering mechanism curbs any meandering of the recording medium in the recording section and curbs disturbance to the recording caused by meandering and the like. Also, the recording medium end sensor is provided between the first bend section and the recording section in the first conveyance route. In other words, the recording medium end sensor is able to detect the position of the end of the recording medium in the width direction at a position of the first conveyance route closer to the recording section, and therefore more highly accurate positional adjustments can be performed with respect to the recording section. As a result, it is possible to provide a recording apparatus with which any decline in the quality of recording provoked by meandering of the roll of paper 1 or the like has been curbed, even in a case where a more compact recording apparatus has been configured, by being provided with the first bend section.

A recording apparatus as in an application example above is characterized by further comprising a post-treatment section configured and arranged to carry out a post-treatment on the recording medium after the liquid has been applied, and a third conveyance route along which the recording medium is conveyed from the recording section to the post-treatment section, the third conveyance route including a third bend section configured and arranged to change the direction in which the recording medium is conveyed.

According to the present application example, the recording apparatus is provided with the post-treatment section, and the third conveyance route along which the recording medium is conveyed from the recording section to the post-treatment section is provided with a third bend section where the direction in which the recording medium is conveyed is changed. Therefore, in the configuration of the recording apparatus, it is possible to arrange in a direction with intersection between the direction in which the post-treatment section extends and with the direction in which the recording section extends. As a result, for example, when the recording apparatus is viewed as projected onto the floor where the recording apparatus is installed, then it becomes possible to arrange the post-treatment section and the recording section so as to each have a region of overlap. Even in a case where the post-treatment section and the recording section cannot be configured so as to overlap, then the post-treatment section can still be installed, for example, in such a direction as where the projection area of the post-treatment section becomes even smaller. In other words, the area occupied by the installation of the recording apparatus can be made narrower, and even in a case where the post-treatment section is provided, it is still possible to provide a more compact recording apparatus that does not require a wide installation space.

A recording apparatus as in an application example above is characterized by further comprising a recording medium storage section configured and arranged to take up into the shape of a roll and store the recording medium after the post-treatment has been performed, and a fourth conveyance route along which the recording medium is conveyed from the post-treatment section to the recording medium storage section, the fourth conveyance route including a fourth bend section configured and arranged to change the direction in which the recording medium is conveyed.

According to the present application example, the recording apparatus is provided with a recording medium storage section for taking up into the shape of a roll and storing the recording medium after the post-treatment has been performed, and a fourth conveyance route along which the recording medium is conveyed from the post-treatment section to the recording medium storage section is provided with a fourth bend section where the direction in which the recording medium is conveyed is changed. Therefore, in the configuration of the recording apparatus, it is possible to arrange so that the direction in which the post-treatment section extends and the direction in which the recording medium is conveyed from the post-treatment section to the recording medium storage section intersect with one another. As a result, the height of the place where the recording apparatus is installed can be further lowered, and it is possible to provide a more compact recording apparatus that does not require a large space even in a case where a post-treatment section is provided.

A recording apparatus as in an application example above is characterized in that the pre-treatment section has a corona discharger.

According to the present application example, the pre-treatment section has a corona discharger, and therefore a treatment for exposing the recording medium to a corona discharge environment can be performed. This corona discharge treatment makes it possible to improve the wettability of the liquid to the recording medium. In other words, according to the present application example, it is possible to provide a more compact recording apparatus that does not require a wide installation space even in a case where a pre-treatment section for improving the wettability of the liquid is provided.

BRIEF DESCRIPTION OF THE DRAWINGS

Referring now to the attached drawings which form a part of this original disclosure.

DETAILED DESCRIPTION OF EXEMPLARY EMBODIMENTS

Embodiments by which the present invention is carried out shall now be described below, with reference to the accompanying drawings. What follows is merely an embodiment of the present invention, and in no way limits the present invention. In each of the following drawings, there are some instances where, for the sake of facilitating understanding, the scale depicted differs from actual practice. Also, in each of the drawings, the Z direction is understood to be the upwards direction (i.e., the -Z direction is the vertical direction), and the X-Y plane is understood to be a plane that is parallel to the plane on which the recording apparatus is installed.

First Embodiment

Figure 1:
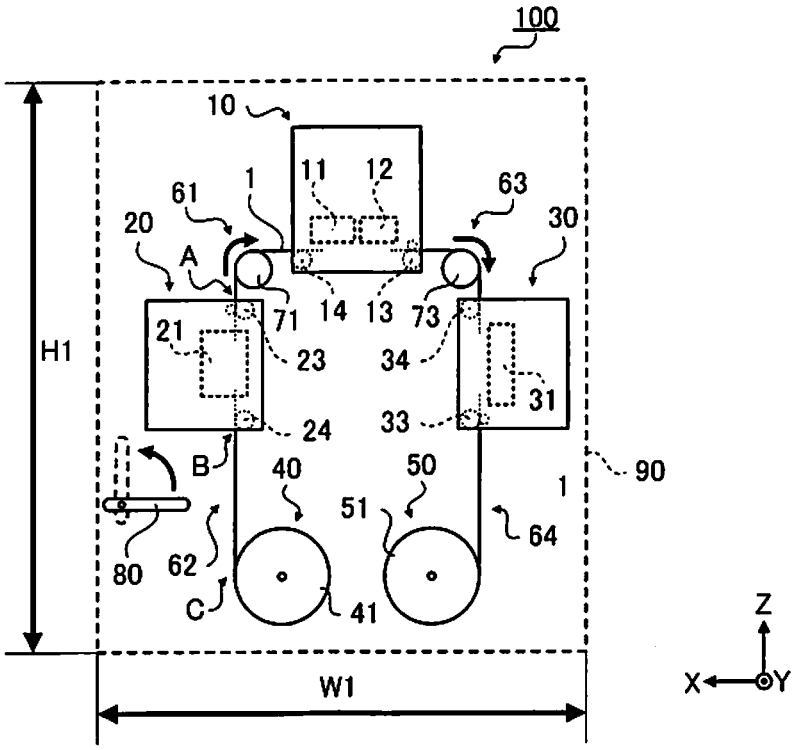
FIG. 1 is a front view schematically illustrating the configuration of a recording apparatus as in a first embodiment.

FIG. 1 is a front view schematically illustrating the configuration of a recording apparatus 100 as in a first embodiment.

The recording apparatus 100 is an inkjet-type printer that uses a UV ink that can be cured by being irradiated with ultraviolet rays as a "liquid", and records an image onto a roll of paper 1 that is supplied in a state of having been wound into a roll as a "recording medium".

The recording apparatus 100 is provided with a recording section 10, a corona treatment section 20 serving as a "pre-treatment section", a drying section 30 serving as a "post-treatment section", a supply section 40 serving as a "recording medium supply section", a take-up section 50 serving as a "recording medium storage section", a first conveyance route 61, a third conveyance route 63, a splicing table 80, and the like, and is unified into a recording apparatus by a housing 90.

The roll of paper 1 is supplied from the supply section 40 and is stored in the take-up section 50 after having been passed through the corona treatment section 20, the recording section 10, and the drying section 30 by a conveyance path provided to the interior of the recording apparatus 100.

As the roll of paper 1, it would be possible to use, for example, high-quality paper, cast paper, art paper, coated paper, or the like. The recording medium is not limited to being these paper-based media, but instead may also be, for example, a film-based medium composed of synthetic paper, polyethylene terephthalate (PET), polypropylene (PP), or the like.

In the following description, out of the two surfaces—front and back—of the roll of paper 1, the "front surface" is the name given to the surface onto which the image is recorded and the "reverse surface" is the name given to the surface on the opposite side thereof.

The recording section 10 is provided with an inkjet head 11 for applying the UV ink onto the front surface of the roll of paper 1 and recording the image, a UV irradiator 12 for irradiating with ultraviolet rays in order to temporarily dry (temporarily cure) the UV ink that has been applied, and the like. The temporary drying of the UV ink by the UV irradiator 12 is intended to dry (temporarily dry) the ink to such an extent that the wet-spreading of the UV ink is sufficiently slowed down compared to a case without irradiation with ultraviolet rays.

A drive roller 13 that feeds the roll of paper 1 out is provided, together with a nip roller, to the conveyance path of the roll of paper 1 in the recording section 10, on the downstream side thereof, and a driven roller 14 that is driven by the drive roller 13 and guides the roll of paper 1 is provided thereto on the upstream side thereof.

The corona treatment section 20 is located on the upstream side of the recording section 10 in the conveyance path of the roll of paper 1 and is provided with a corona discharge electrode 21 serving as a "corona discharger" for performing a corona discharge treatment on the front surface of the roll of paper 1 prior to the application of the UV ink. Performing the corona discharge treatment on the front surface of the roll of paper 1 makes it possible to improve the wettability of the UV ink.

A drive roller 23 that is ancillary to nip rollers and feeds the roll of paper 1 out is provided to the conveyance path of the roll of paper 1 in corona treatment section 20, on the downstream side thereof, and a driven roller 24 that is driven by the drive roller 23 and guides the roll of paper 1 is provided thereto on the upstream side thereof.

The drying section 30 is located on the upstream side of the recording section 10 in the conveyance path of the roll of paper 1, and is provided with, inter alia, a UV irradiator 31 for completely drying (completely curing) the roll of paper 1 after the temporary drying to which the UV ink has been applied. The UV irradiator is intended to cure the ink to such an extent that wet spreading of the UV ink is stopped, by irradiating with ultraviolet rays of a greater irradiation intensity than that of the UV irradiator 12.

A drive roller 33 that is ancillary to nip rollers and feeds the roll of paper 1 out is provided to the conveyance path of the roll of paper 1 in the drying section 30, on the downstream side thereof, and a driven roller 34 that is driven by the drive roller 33 and guides the roll of paper 1 is provided thereto on the upstream side thereof.

The supply section 40 is a recording medium supply section for storing the roll of paper 1 before the corona discharge treatment is performed, and is located on the upstream side of the corona treatment section 20 in the conveyance path of the roll of paper 1 and is provided with a supply reel 41 and the like.

The supply reel 41 is rotated by a supply motor (not shown) and supplies the roll of paper 1 out toward the corona treatment section 20, which is arranged on the downstream side of the supply section 40.

The take-up section 50 is a recording medium storage section for taking up and storing the roll of paper 1 after the complete drying has been performed, and is located on the downstream side of the drying section 30 in the conveyance path of the roll of paper 1 and is provided with a take-up reel 51 and the like.

The take-up reel 51 is rotated by a take-up motor (not shown) and takes up that roll of paper 1 that has been fed through the drying section 30 which is arranged on the upstream side of the take-up section 50.

The conveyance path comprises respective internal paths of the recording section 10, the corona treatment section 20, and the drying section 30, as well as the supply section 40 and the take-up section 50, and is constituted of the first conveyance route 61 through a fourth conveyance route 64 that connect each one.

The first conveyance route 61 is a path along which the roll of paper 1 is conveyed from the corona treatment section 20 to the recording section 10, and is provided with a first bend section 71 where the direction in which the roll of paper 1 is being conveyed is changed. More specifically, the first conveyance route 61 is a path along which the roll of paper 1 is conveyed that is constituted of the drive roller 23, the first bend section 71, and the driven roller 14.

The first bend section 71 is constituted of a driven roller over which the roll of paper 1 is taut and which follows the movement of the roll of paper 1 being conveyed. The first bend section 71 has the direction in which the roll of paper 1 is being conveyed change from the direction going from the drive roller 23 toward the first bend section 71 to the direction going from the first bend section 71 toward the driven roller 14. In other words, the direction going from the drive roller 23 towards the driven roller 14 (the direction going from the corona treatment section 20 towards the recording section 10) is bent. The example illustrated in FIG. 1 has bending from the vertical direction going from the drive roller 23 toward the first bend section 71 to the horizontal direction going from the first bend section 71 toward the driven roller 14.

The first bend section 71 may also be constituted of a drive roller for driving the conveyance of the roll of paper 1. The first bend section 71 may also be constituted of a combination of a driven roller and a drive roller. In a case where the first bend section 71 is configured so as to comprise a drive roller, then the drive roller 23 may be a driven roller.

The first bend section 71 is also provided with a tension sensor (not shown) for detecting the tension received by the roll of paper 1 at the first conveyance route 61. The tension received by the roll of paper 1 at the first conveyance route 61 generates a stress on the first bend section 71 where the direction of conveyance of the roll of paper 1 is changed on the first conveyance route 61. Detecting this stress at the first bend section 71 makes it possible to detect the tension received by the roll of paper 1.

The third conveyance route 63 is a path along which the roll of paper 1 is conveyed from the recording section 10 to the drying section 30, and is provided with a third bend section 73 where the direction in which the roll of paper 1 is being conveyed is changed. More specifically, the third conveyance route 63 is a path along which the roll of paper 1 is conveyed that is constituted of the drive roller 13, the third bend section 73, and the driven roller 34.

The third bend section 73 is constituted of a driven roller over which the roll of paper 1 is taut and which follows the movement of the roll of paper 1 being conveyed. The third bend section 73 has the direction in which the roll of paper 1 is being conveyed change from the direction going from the drive roller 13 toward the third bend section 73 to the direction going from the third bend section 73 toward the driven roller 34. In other words, the direction going from the drive roller 13 toward the driven roller 34 (the direction going from the recording section 10 toward the drying section 30) is bent. The example illustrated in FIG. 1 has bending from the horizontal direction going from the drive roller 13 toward the third bend section 73 to the vertical direction going from the third bend section 73 toward the driven roller 34.

The third bend section 73 may be constituted of a drive roller for driving the conveyance of the roll of paper 1. The third bend section 73 may also be constituted of a combination of a driven roller and a drive roller. In a case where the third bend section 73 is configured so as to comprise a drive roller, then the drive roller 13 may be a driven roller.

The second conveyance route 62 is a path along which the roll of paper 1 is conveyed from the supply section 40 to the corona treatment section 20. The fourth conveyance route 64 is a path along which the roll of paper 1 is conveyed from the drying section 30 to the take-up section 50.

As illustrated in FIG. 1, in the conveyance path, a position A (pre-treatment exit position) of the corona treatment section 20 for exit from which the roll of paper 1 is fed out is provided to a higher position than a position B (pre-treatment entry position) of the corona treatment section 20 for entry of the roll of paper 1 entering in; in the first conveyance route 61, the first bend section 71 is provided to a higher position than the position A; and, in the second conveyance route 62, the position B is provided to a higher position than a position C for the supply section 40 from which the roll of paper 1 is fed out.

Also, in the present embodiment, the supply section 40 is arranged at a position overlapping with the corona treatment section 20, the first conveyance route 61, and the recording section 10 when the recording apparatus 100 is viewed as being projected onto a floor surface on which the recording apparatus 100 is installed, due to the conveyance path being provided in the manner described above.

The splicing table 80 is provided to a region between the supply section 40 and the corona treatment section 20. The splicing table 80 is used as a work platform for when a worker is joining rolls of paper 1 together. In a more detailed description; for example, in a case where the roll of paper 1 that is fed out from the supply section 40 is finished and a new roll of paper 1 is set up, then it is necessary to join the new roll of paper 1 to the old roll of paper 1 that has been set up on the recording apparatus 100. Thus, the worker performs the task (splicing) of using splicing tape to join the upstream end of the old roll of paper 1 in the direction of conveyance with the downstream end of the new roll of paper 1 in the direction of conveyance, on the splicing table 80.

The splicing table 80 is provided so as to be movable. In a more detailed description, the splicing table 80 can be installed horizontally at a position close to the conveyance path of the roll of paper 1, in a region between the supply section 40 and the corona treatment section 20, so as to facilitate work for the worker when performing the splicing. When, prior to this, the worker sets the new roll of paper 1 up onto the supply section 40, then ample space for unencumbered performance of the task of setting the new roll of paper 1 up on the supply section 40 in some instances cannot be ensured while the splicing table 80 remains installed at this position (the position close to the conveyance path of the roll of paper 1 in the region between the supply section 40 and the corona treatment section 20). Therefore, having the splicing table 80 be movable makes it possible to ensure ample space. In the example illustrated in FIG. 1, the splicing table 80 is provided so as to allow for being flipped up in the vertical direction pivoting about a support shaft provided on the side away from the conveyance path of the roll of paper 1.

According to the recording apparatus as in the present embodiment, as described above, the following effects can be obtained.

The first conveyance route 61, along which the roll of paper 1 is conveyed from the corona treatment section 20 to the recording section 10, is provided with the first bend section 71 where the direction in which the roll of paper 1 is conveyed is changed. Therefore, in the configuration of the recording apparatus 100, it is possible to arrange in a direction with intersection between the direction in which the corona treatment section 20 extends and with the direction in which the recording section 10 extends. As a result, for example, when the recording apparatus 100 is viewed as projected onto the floor where the recording apparatus 100 is installed, then it becomes possible to arrange the corona treatment section 20 and the recording section 10 so as to each have a region of overlap. Even in a case where the corona treatment section 20 and the recording section 10 cannot be configured so as to overlap, then the corona treatment section 20 can still be installed, for example, in such a direction as where the projection area of the corona treatment section 20 becomes even smaller. In other words, the area occupied by the installation of the recording apparatus can be made narrower, and even in a case where the corona treatment section 20 is provided, it is still possible to provide a more compact recording apparatus that does not require a wide installation space.

The third conveyance route 63, along which the roll of paper 1 is conveyed from the recording section 10 to the drying section 30, is provided with the third bend section 73 where the direction in which the roll of paper 1 is conveyed is changed. Therefore, in the configuration of the recording apparatus 100, it is possible to arrange in a direction with intersection between the direction in which the drying section 30 extends and with the direction in which the recording section 10 extends. As a result, for example, when the recording apparatus 100 is viewed as projected onto the floor where the recording apparatus 100 is installed, then it becomes possible to arrange the drying section 30 and the recording section 10 so as to each have a region of overlap. Even in a case where the drying section 30 and the recording section 10 cannot be configured so as to overlap, then the drying section 30 can still be installed, for example, in such a direction as where the projection area of the drying section 30 becomes even smaller. In other words, the area occupied by the installation of the recording apparatus can be made narrower, and even in a case where the drying section 30 is provided, it is still possible to provide a more compact recording apparatus that does not require a wide installation space.

Figure 2:
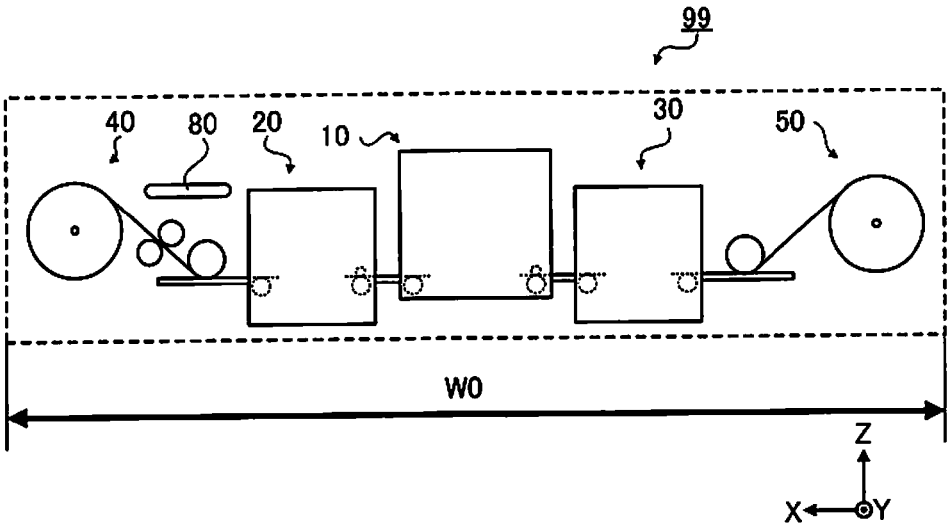
Fig. 2 (Prior Art)
FIG. 2 is a front view schematically illustrating the configuration of a conventional recording apparatus.

FIG. 2 schematically illustrates an example of the configuration of a conventional recording apparatus 99. The recording apparatus 99 is not provided with the first bend section 71 nor with the third bend section 73, and therefore the corona treatment section 20, the recording section 10, and the drying section 30 are arranged so as to extend in series. As a result, installation requires a wide space than is the case with the recording apparatus 100. As illustrated with the ranges of the arrows in the X direction in FIGS. 1 and 2, according to the recording apparatus 100 of the present embodiment, it is possible to provide a more compact recording apparatus that does not require a wide installation space, in comparison to the conventional recording apparatus 99.

The position A of the corona treatment section 20 for exit from which the roll of paper 1 is fed out is provided to a higher position than the position B of the corona treatment section 20 for entry of the roll of paper 1 entering in; in the first conveyance route 61, along which the roll of paper 1 is conveyed from the corona treatment section 20 to the recording section 10, the first bend section 71 is provided to a higher position than the position A; and, in the second conveyance route, along which the roll of paper 1 is conveyed from the supply section 40 to the corona treatment section 20, the position B is provided to a higher position than the position C for the supply section 40 from which the roll of paper 1 is fed out. In other words, the conveyance route of the roll of paper 1 going from the exit of the supply section 40 towards the first bend section 71 is provided in a direction that grows successively higher going towards the direction of conveyance. As a result, where the corona treatment section 20 is provided, the conveyance route can still be configured more simply even in a case where the first bend section 71 has been provided so as not to require a wide installation space. More specifically, the position C, the position B, the position A, and the first bend section 71 can be configured so as to be arranged side by side on a substantially straight line. Also, in such a case, there is no longer a need to provide, inter alia, a bend section for changing the direction of conveyance in the second conveyance route 62 nor in the first conveyance route 61 leading up to the first bend section 71. Because a path that bends at an acute angle (90° or less) is not formed on the conveyance route in the second conveyance route 62 nor in the first conveyance route 61 leading up to the first bend section 71, the impact on the roll of paper 1 from a path that is bent can be reduced.

Also, with the recording apparatus 100, the supply section 40 is arranged at a position of overlap with the first conveyance route 61 and the recording section 10 when the recording apparatus 100 is viewed as projected onto the floor surface where the recording apparatus 100 is installed. In other words, the floor surface where the recording apparatus 100 is installed may be a smaller area than in a case where the supply section 40, the corona treatment section 20, the first conveyance route 61, and the recording section 10 are each arranged in series. As such, according to the present embodiment, it is possible to provide a more compact recording apparatus that does not require a wide installation space.

The splicing table 80 for splicing the roll of paper 1, which has been led out from the supply section 40, is provided to the region between the supply section 40 and the corona treatment section 20. In other words, the task of splicing the roll of paper 1 can be easily performed on a roll of paper 1 that is near at hand, having been drawn out from the supply section 40 before being introduced into the corona treatment section 20. As a result, splicing can be performed without having to wastefully pull out the roll of paper 1 to be joined newly in order to perform the task of splicing or having to pass the roll of paper 1 to be joined newly through the corona treatment section 20 every time the task of splicing is performed.

Also, the splicing table 80 is provided so as to be movable. The splicing table 80 is arranged close to the supply section 40, as stated above, and so doing makes it possible to perform splicing without having to wastefully pull out the roll of paper 1 to be joined newly in order to perform the task of splicing or having to pass the roll of paper 1 to be joined newly through the corona treatment section 20 every time the task of splicing is performed. However, when the splicing table 80 is arranged close to the supply section 40, this may in some instances hinder the task of storing the roll of paper 1 in the supply section 40. When the splicing table 80 is provided so as to be movable, as in the present embodiment, the splicing table 80, for example can be arranged close to the supply section 40 in a case where the splicing task is being performed and can be moved to a position away from the supply section 40 in a case where the task of storing the roll of paper 1 in the supply section 40 is being performed, and this makes it even easier to perform each of these tasks.

Also, the first bend section 71 is also provided with the tension sensor for detecting the tension received by the roll of paper 1 at the first conveyance route 61. A simpler configuration is achieved because there is no need for the first bend section 71 and the tension sensor to be provided separately from one another.

Also, because the corona treatment section 20 has the corona discharger, a treatment where the roll of paper 1 is exposed to a corona discharge environment can be performed. This corona discharge treatment makes it possible to improve the wettability of the UV ink to the roll of paper 1. In other words, according to the present embodiment, it is still possible to provide a more compact recording apparatus that does not require a wide installation space even in a case where the corona treatment section 20 for improving the wettability of the UV ink is provided.

Second Embodiment

Next, a recording apparatus as in a second embodiment shall be described. In the description, constituent sites identical to those of the embodiment described above receive identical reference numerals and any redundant description is omitted.

Figure 3:
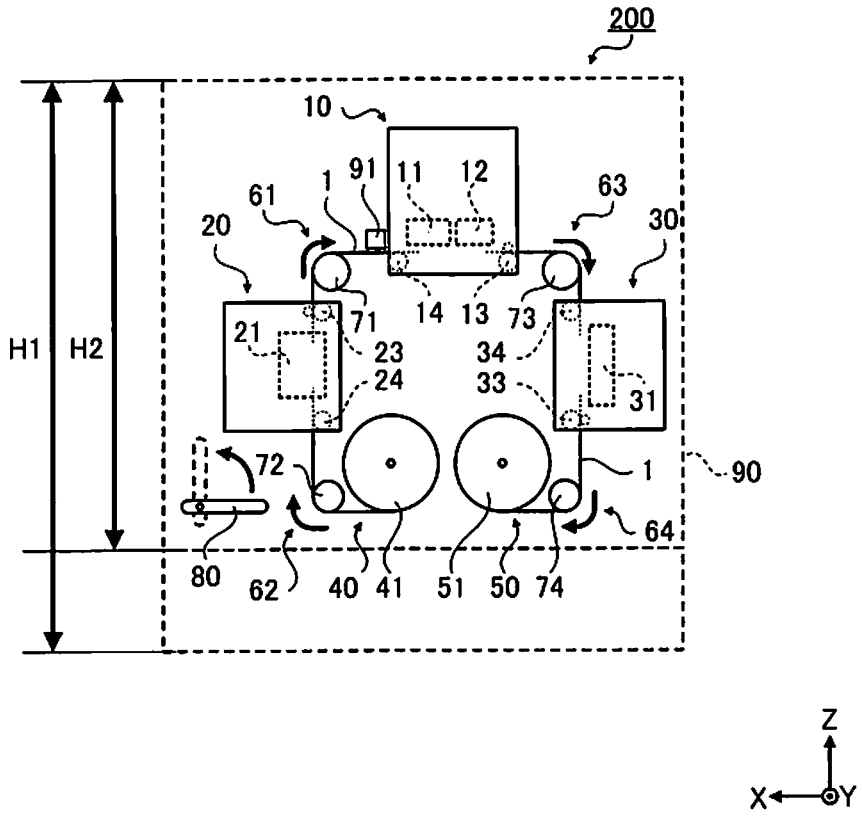
FIG. 3 is a front view schematically illustrating the configuration of a recording apparatus as in a second embodiment.

FIG. 3 is a front view schematically illustrating the configuration of a recording apparatus 200 as in the second embodiment.

The recording apparatus 200 is characterized in that the second conveyance route 62 is provided with a second bend section 72 and the fourth conveyance route 64 is provided with a fourth bend section 74.

In the first embodiment (the recording apparatus 100), the second conveyance route 62 along which the roll of paper 1 is conveyed from the supply section 40 to the corona treatment section 20 was connected with a straight line, but in the recording apparatus 200, the second conveyance route 62 if provided with the second bend section 72, where the direction in which the roll of paper 1 is conveyed is changed.

The second bend section 72 is constituted of a driven roller over which the roll of paper 1 is taut and which follows the movement of the roll of paper 1 being conveyed. The second bend section 72 has the direction in which the roll of paper 1 is being conveyed change from the direction going from the supply section 40 toward the second bend section 72 to the direction going from the second bend section 72 toward the corona treatment section 20 (the driven roller 24). In other words, the direction going from the supply section 40 toward the corona treatment section 20 is bent. The example illustrated in FIG. 3 has bending from the horizontal direction going from the supply section 40 toward the second bend section 72 (which, however, varies depending on the amount of roll of paper 1 in the supply section 40) to the vertical direction going from the second bend section 72 toward the corona treatment section 20.

The second bend section 72 may be constituted of a drive roller for driving the conveyance of the roll of paper 1. The second bend section 72 may also be constituted of a combination of a driven roller and a drive roller.

Also, in the recording apparatus 100, the fourth conveyance route 64 along which the roll of paper 1 is conveyed from the drying section 30 to the take-up section 50 was connected with a straight line, but in the recording apparatus 200, the fourth conveyance route 64 is provided with the fourth bend section 74, where the direction in which the roll of paper 1 is conveyed is changed.

The fourth bend section 74 is constituted of a driven roller over which the roll of paper 1 is taut and which follows the movement of the roll of paper 1 being conveyed. The fourth bend section 74 has the direction in which the roll of paper 1 is being conveyed change from the direction going from the drying section 30 (the drive roller 33) toward the fourth bend section 74 to the direction going from the fourth bend section 74 toward the take-up section 50. In other words, the direction going from the drying section 30 toward the take-up section 50 is bent. The example illustrated in FIG. 3 has bending from the vertical direction going from the drive roller 33 toward the fourth bend section 74 to the horizontal direction going from the fourth bend section 74 toward the take-up section 50 (which, however, varies depending on the amount of roll of paper 1 in the take-up section 50).

The fourth bend section 74 may also be constituted of a drive roller for driving the conveyance of the roll of paper 1. The fourth bend section 74 may also be constituted of a combination of a driven roller and a drive roller.

Also, the recording apparatus 200 is provided with a steering mechanism (not shown) for curbing any meandering of the roll of paper 1, in particular in the path in the recording section 10. The steering mechanism detects variations in the end position of the width direction caused by meandering of the roll of paper 1 and controls the movement of the roll of paper 1 so that the roll of paper 1 is conveyed at a predetermined position in the recording section 10. The recording apparatus 200 is provided with a recording medium end sensor 91 as a sensor for detecting the width-direction end position of the roll of paper 1 being conveyed in the first conveyance route 61. The recording medium end sensor 91 is provided between the first bend section 71 and the recording section 10 in the first conveyance route 61, as illustrated in FIG. 3.

The steering mechanism curbs meandering of the roll of paper 1 by performing a control on the basis of the positional information about the end of the roll of paper 1 as detected by the recording medium end sensor 91, such as, for example, finely moving the axial direction of the drive roller or driven roller forming the first conveyance route.

According to the recording apparatus as in the present embodiment, the following effects can be obtained.

In the recording apparatus 200, the second conveyance route 62 is provided with the second bend section 72 where the direction in which the roll of paper 1 is conveyed is changed, and the fourth conveyance route 64 is provided with the fourth bend section 74 where the direction in which the roll of paper 1 is conveyed is changed. Therefore, in the configuration of the recording apparatus 200, it is possible to arrange so that the direction in which the corona treatment section 20 extends and the direction in which the roll of paper 1 is conveyed from the supply section 40 to the corona treatment section 20 intersect. It is also possible to arrange so that the direction in which the drying section 30 extends and the direction in which the roll of paper 1 is conveyed from the drying section 30 to the take-up section 50 intersect. As a result, it becomes possible for the corona treatment section 20 and the supply section 40, and the drying section 30 and the take-up section 50, to be each arranged so as to have regions of overlap, when the recording apparatus is viewed as being projected onto a wall surface of a room where the recording apparatus is installed. For example, as illustrated in FIG. 3, it is possible to configure so as to lower the height of the apparatus, as per the height H2 of the recording apparatus 200 with respect to the height H1 of the recording apparatus 100. In other words, the height of the place where the recording apparatus 200 is installed can be further lowered, and it is possible to provide a more compact recording apparatus that does not require a large space even in a case where a pre-treatment section such as the corona treatment section 20 or a post-treatment section such as the drying section 30 is provided.

Also, the recording apparatus 200 is provided with the recording medium end sensor 91 for detecting the position of the width-direction end of the roll of paper 1 being conveyed in the first conveyance route 61, and the steering mechanism for carrying out positional adjustments in the width direction for the roll of paper 1 being conveyed in the first conveyance route 61. This steering mechanism curbs any meandering of the roll of paper 1 in the recording section 10 and curbs disturbance to the recording caused by meandering and the like. Also, the recording medium end sensor 91 is provided between the first bend section 71 and the recording section 10 in the first conveyance route 61. In other words, the recording medium end sensor 91 is able to detect the position of the end of the roll of paper 1 in the width direction at a position of the first conveyance route 61 closer to the recording section 10, and therefore more highly accurate positional adjustments can be performed with respect to the recording section 10. As a result, it is possible to provide a recording apparatus with which any decline in the quality of recording provoked by meandering of the roll of paper 1 or the like has been curbed, even in a case where a more compact recording apparatus has been configured, by being provided with the first bend section 71.

The present invention is not limited to the embodiments described above, but rather a variety of modifications, improvements, or the like could be made to the embodiments described above. Modification examples shall be described below. Here, constituent sites identical to those of the embodiments described above receive identical reference numerals and any redundant description is omitted.

First Modification Example

Figure 4:
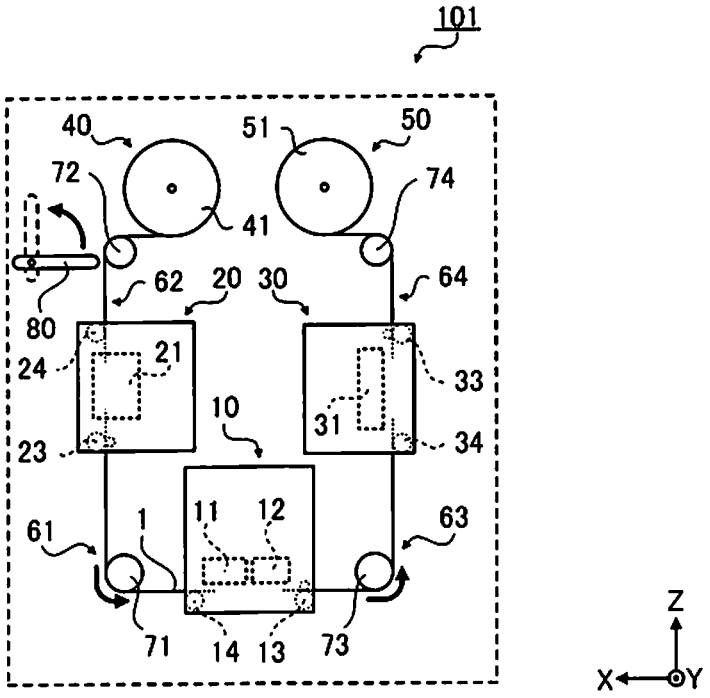
FIG. 4 is a front view schematically illustrating the configuration of a recording apparatus as in a first modification example.

FIG. 4 is a front view schematically illustrating the configuration of a recording apparatus 101 as in a first modification example.

The first embodiment, as illustrated in FIG. 1, describes an example where the corona treatment section 20 serving as the "pre-treatment section" and the drying section 30 serving as the "post-treatment section" are arranged below the recording section 10 by the provision of the first bend section 71 and the third bend section 73, but there is no limitation to being this configuration. For example, the configuration may be such that the corona treatment section 20 serving as the "pre-treatment section" and the drying section 30 serving as the "post-treatment section" are arranged above the recording section 10 by the provision of the first bend section 71 and the third bend section 73, as per the recording apparatus 101.

Second Modification Example

Figure 5:
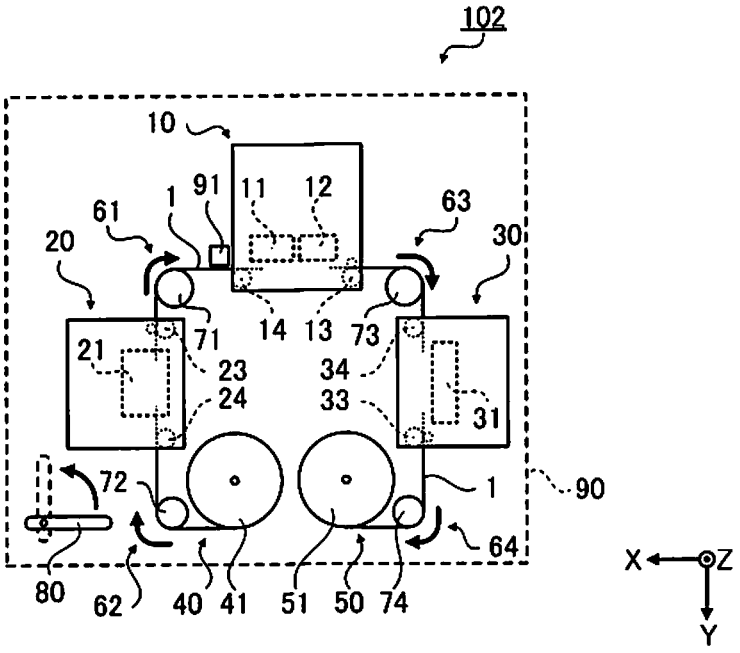
FIG. 5 is a plan view schematically illustrating the configuration of a recording apparatus as in a second modification example.
Figure 6:
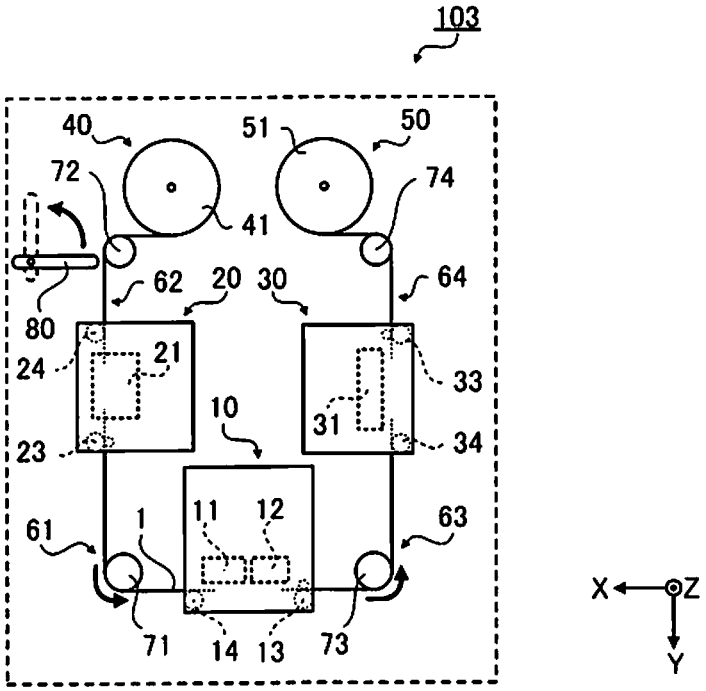
FIG. 6 is a plan view schematically illustrating the configuration of a recording apparatus as in the second modification example.

FIGS. 5 and 6 are plan views schematically illustrating the configurations of recording apparatus 102, 103 as in a second modification example.

The first and second embodiment and the first modification example described an example where the corona treatment section 20 serving as the "pre-treatment section" and the drying section 30 serving as the "post-treatment section" are arranged either above or below the recording section 10 by the provision of the first bend section 71 and the third bend section 73, as illustrated in FIGS. 1, 3, and 4, but there is no limitation to being this configuration. For example, the configuration may be such that the corona treatment section 20 serving as the "pre-treatment section" and the drying section 30 serving as the "post-treatment section" are arranged in the lateral direction of the recording section 10, by the provision of the first bend section 71 and the third bend section 73, as per the recording apparatuses 102, 103.

In the case of the present modification example, it is preferable that the roll of paper 1 in the recording section 10 is conveyed so that the surface thereof stands in the vertical direction and therefore this modification example is preferably applied to a case where there will be either no or a negligible amount of falling of the liquid (ink) applied to the front surface of the roll of paper and where the image being recorded is not affected.

Also, the case of the present modification example has none or little of the effect of reducing the installation floor space for the recording apparatus, but because the corona treatment section 20, the recording section 10, and the drying section 30 are not arranged so as to extend in series as is the case with the conventional recording apparatus 99 illustrated in FIG. 2, there are effects such as the fact that installation remains possible even in a case where a long installation space cannot be taken or the like.

The first embodiment and the first and second modification examples described by way of example the roll of paper 1 that is supplied in a state of having been wounded into a roll, serving as the "recording medium", but the "recording medium" is in no way limited to being a roll of medium nor to being a continuous medium. The "recording medium" may be, for example, a cut sheet. In such a case, there would be provided a conveying means for the path by which the cut sheet would be supplied from the supply section, pass by way of the pre-treatment section, the recording section, and the post-treatment section, and be stored in the storage section; in this conveying means, there would be provided a means for bending the conveyance path, similarly with respect to the first bend section 71 through fourth bend section 74, thereby making it possible to obtain a similar effect.

The first embodiment and the first and second modification examples described by way of example a configuration in which the "pre-treatment section" is the corona treatment section 20 and the "post-treatment section" is the drying section 30, but there is no limitation thereto. The "pre-treatment section" may be, for example, a treatment section for treating the recording medium prior to recording with a surface coating treatment, a heating treatment, a humidification treatment, a cutting treatment for modifying the width of the roll of paper, or the like. The "post-treatment section" also likewise may be, for example, a treatment section for treating the recording medium after recording with a surface coating treatment, a heating treatment, a humidification treatment, a cutting treatment for modifying the width of the roll of paper, a cut-out treatment, or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a recording section configured and arranged to apply an ink to a recording medium to record an image on the recording medium;

a pre-treatment section configured and arranged to perform a pre-treatment on the recording medium before the ink is applied;

a first conveyance route along which the recording medium is conveyed from the pre-treatment section to the recording section;

a post-treatment section configured and arranged to carry out a post-treatment on the recording medium after the ink has been applied; and a third conveyance route along which the recording medium is conveyed from the recording section to the post-treatment section, the first conveyance route including a first bend section configured and arranged to change a direction in which the recording medium is conveyed, the third conveyance route including a third bend section configured and arranged to change the direction in which the recording medium is conveyed.

2. The recording apparatus as set forth in claim 1, further comprising a recording medium supply section configured and arranged to store the recording medium having been wound into a roll prior to when the pre-treatment is performed; and a second conveyance route along which the recording medium is conveyed from the recording medium supply section to the pre-treatment section, the second conveyance route including a second bend section configured and arranged to change the direction in which the recording medium is conveyed.

3. The recording apparatus as set forth in claim 1, further comprising a recording medium supply section configured and arranged to store the recording medium having been wound into a roll prior to when the pre-treatment is performed; and a second conveyance route along which the recording medium is conveyed from the recording medium supply section to the pre-treatment section, a pre-treatment exit position for the pre-treatment section from which the recording medium is fed out being provided to a higher position than a pre-treatment entry position for the pre-treatment section at which the recording medium enters in, the first bend section being provided in the first conveyance route at a higher position than the pre-treatment exit position, and the pre-treatment entry position being provided in the second conveyance route at a higher position than a position for the recording medium supply section from which the recording medium is fed out.

4. The recording apparatus as set forth in claim 2, wherein the recording medium supply section is provided to a position where the recording medium supply section overlaps with at least one of the pre-treatment section, the first conveyance route, and the recording section when the recording apparatus is viewed as being projected onto a floor surface where the recording apparatus is installed.

5. The recording apparatus as set forth in claim 1, further comprising a recording medium storage section configured and arranged to take up into a shape of a roll and store the recording medium after the post-treatment has been performed; and a fourth conveyance route along which the recording medium is conveyed from the post-treatment section to the recording medium storage section, the fourth conveyance route including a fourth bend section configured and arranged to change the direction in which the recording medium is conveyed.

6. The recording apparatus as set forth in claim 1, wherein the pre-treatment section has a corona discharger.

7. A recording apparatus comprising:

a recording section configured and arranged to apply a liquid to a recording medium and record an image;

a pre-treatment section configured and arranged to perform a pre-treatment on the recording medium before the liquid is applied;

a first conveyance route along which the recording medium is conveyed from the pre-treatment section to the recording section;

a recording medium supply section configured and arranged to store the recording medium having been wound into a roll prior to when the pre-treatment is performed;

a second conveyance route along which the recording medium is conveyed from the recording medium supply section to the pre-treatment section;

a splicing table configured and arranged to splice the recording medium having been led out from the recording medium supply section, the first conveyance route including a first bend section configured and arranged to change a direction in which the recording medium is conveyed, the second conveyance route including a second bend section configured and arranged to change the direction in which the recording medium is conveyed, the splicing table being provided to a region between the recording medium supply section and the pre-treatment section.

8. The recording apparatus as set forth in claim 7, wherein the splicing table is provided so as to be movable.

9. A recording apparatus comprising:

a recording section configured and arranged to apply a liquid to a recording medium and record an image;

a pre-treatment section configured and arranged to perform a pre-treatment on the recording medium before the liquid is applied; and a first conveyance route along which the recording medium is conveyed from the pre-treatment section to the recording section, the first conveyance route including a first bend section configured and arranged to change a direction in which the recording medium is conveyed, the first bend section including a tension sensor configured and arranged to detect a tension received by the recording medium in the first conveyance route.

10. A recording apparatus comprising:

a recording section configured and arranged to apply a liquid to a recording medium and record an image;

a pre-treatment section configured and arranged to perform a pre-treatment on the recording medium before the liquid is applied;

a first conveyance route along which the recording medium is conveyed from the pre-treatment section to the recording section;

a recording medium end sensor configured and arranged to detect to a position of an end of a width direction of the recording medium being conveyed in the first conveyance route; and a steering mechanism configured and arranged to carry out positional adjustments in the width direction for the recording medium being conveyed in the first conveyance route based on positional information about the end detected by the recording medium end sensor, the first conveyance route including a first bend section configured and arranged to change a direction in which the recording medium is conveyed, the recording medium end sensor being provided between the first bend section and the recording section in the first conveyance route.

* * * * *